United States Patent [19]

Nagata

[11] Patent Number: 4,949,847

[45] Date of Patent: Aug. 21, 1990

[54] STORAGE RECEPTACLE

[75] Inventor: Kohji Nagata, Yao, Japan

[73] Assignee: Matsushita Refrigeration Company, Osaka, Japan

[21] Appl. No.: 306,204

[22] Filed: Feb. 2, 1989

Related U.S. Application Data

[63] Continuation of Ser. No. 35,281, Apr. 7, 1987, abandoned.

[30] Foreign Application Priority Data

Apr. 7, 1986 [JP] Japan ..... 61-79748
Jul. 29, 1986 [JP] Japan ..... 61-178068

[51] Int. Cl.[5] ..... B65D 81/24; B65D 65/40

[52] U.S. Cl. ..... 206/484.1; 426/106; 426/127; 426/419; 426/415; 99/467

[58] Field of Search ..... 426/419, 112, 127, 118, 426/415, 396; 206/484.1; 99/467

[56] References Cited

U.S. PATENT DOCUMENTS

| | | | |
|---|---|---|---|
| 2,452,174 | 10/1948 | Arnold | 426/106 |
| 3,102,777 | 9/1963 | Bedrosian et al. | 426/419 |
| 3,366,673 | 1/1968 | Wakeman et al. | 426/133 |
| 3,423,212 | 1/1969 | Purcell et al. | 426/415 |
| 3,427,316 | 2/1969 | Wakeman et al. | 426/133 |
| 3,450,543 | 6/1969 | Badran et al. | 426/415 |
| 3,450,544 | 6/1969 | Badran et al. | 426/419 |
| 3,507,667 | 4/1970 | Magnen | 426/419 |
| 3,682,028 | 8/1972 | Clayton et al. | 426/419 |
| 4,061,785 | 12/1977 | Nishino et al. | 426/419 |
| 4,224,347 | 9/1980 | Woodruff | 426/419 |
| 4,423,080 | 12/1983 | Bedrosian et al. | 426/419 |
| 4,515,266 | 5/1985 | Myers | 426/419 |
| 4,711,789 | 12/1987 | Orr et al. | 426/419 |
| 4,769,262 | 9/1988 | Ferrar et al. | 426/419 |

FOREIGN PATENT DOCUMENTS

| | | | |
|---|---|---|---|
| 28492 | 8/1930 | Australia | 426/419 |
| 178218 | 4/1986 | European Pat. Off. | 426/106 |
| 1590579 | 5/1970 | France | 406/419 |
| 2033541 | 12/1970 | France | 426/419 |
| 2531042 | 2/1984 | France | 426/118 |
| 740190 | 6/1980 | U.S.S.R. | 426/419 |
| 829484 | 5/1981 | U.S.S.R. | 426/106 |

OTHER PUBLICATIONS

Condensed Chemical Dictionary 8th Ed. 1971 Van Nostrand p. 713.

Modern Packaging vol. 40 #2 pp. 169–172, 254 426/419.

Wiley Encyclopedia of Packaging Technology (Bakker–Ed.) Wiley & Sons 1986.

*Primary Examiner*—Steven Weinstein

*Attorney, Agent, or Firm*—Wenderoth, Lind & Ponack

[57] ABSTRACT

A storage receptacle provided with a receptacle body opened on its upper side, a covering member for covering the opening portion of the receptacle body and a permeable film member having a permeability to gases and a moisture permeability from 1500 to 3500 g/m$^2$·24 hr and formed at least on a portion of the receptacle body or covering member.

3 Claims, 4 Drawing Sheets

STORAGE RECEPTACLE

This application is a continuation of now abandoned application Ser. No. 035,281, filed Apr. 7, 1987.

BACKGROUND OF THE INVENTION

The present invention generally relates to a container for storage and more particularly, to a storage receptacle for storing therein vegetables in a fresh condition, with the storage receptacle being accommodated in a chilled room such as in a refrigerator or the like.

Conventionally, when vegetables are requested to be stored in a fresh condition for a long time, they are initially put into a storage receptacle and the storage receptacle storing the vegetables therein is, then, accommodated in a refrigerator, while it is hermetically covered with increased air-tightness to prevent the vegetables from being dried or withered.

By the above described construction, however, since the storage receptacle is of a completely sealed construction, moisture vaporized from the vegetables, particularly leafy vegetables, forms dew on the inner surface of a cover which covers an opening defined on the upper side of the receptacle and as a result, a large amount of dew tends to adhere thereon. This is because a temperature difference is produced between opposite faces of the cover. The temperature difference results from the fact that the storage receptacle for storing therein the vegetables is generally located at the bottom of a coldroom and the external surface of the cover is, therefore, cooled by cold air within the coldroom, while the inside of the storage receptacle is relatively high in temperature on account of breathing the heat of the vegetables. The large amount of dew caused to adhere to the inner surface of the cover drops spontaneously or due to some vibration or the like in case of taking in and out of the storage receptacle followed by opening and shutting of the cover, and consequently, the dew stays on the surfaces of the vegetables stored or collects at the bottom of the storage receptacle. Accordingly, although the vegetables are kept in a fresh condition for a first few days from the initial storage thereof due to the fact that the vegetables are prevented from being dried during this period, they are damaged before long by the collecting water, thus resulting in a problem such that the vegetables become bad. It has been, therefore, difficult to store the vegetables in a fresh condition for a long time. In particular, in the case where fresh vegetables, particularly leafy vegetables, are additionally put into a storage receptacle which already contains other vegetables therein, which have been stored for a few days, there occurs problems in that the vegetables previously stored are rapidly damaged or spoiled by the moisture vaporized from the fresh vegetables.

SUMMARY OF THE INVENTION

Accordingly, the present invention has been developed with a view toward substantially eliminating the above described disadvantages inherent in the prior art storage receptacle, and has for its essential object to provide an improved storage receptacle which is capable of storing therein vegetables in a fresh condition for a long time, with the humidity inside the storage receptacle being kept in a range most suitable for the storage of the vegetables by restricting the moisture condensation on the cover of the storage receptacle.

Another important object of the present invention is to provide a storage receptacle of the above described type which suits best to the storage within a refrigerator.

A further object of the present invention is to provide a storage receptacle of the above described type which is capable of preventing bacteria or funguses from propagating.

In accomplishing these and other objects, according to one preferred embodiment of the present invention, there is provided a storage receptacle including a receptacle body opened on its upper side, a cover for covering the opening portion of the receptacle body and a permeable film having a permeability to gases and a moisture permeability from 1500 to 3500 $g/m^2 \cdot 24$ hr and formed at least on a portion of the receptacle body or the cover.

BRIEF DESCRIPTION OF THE DRAWINGS

These and other objects and features of the present invention will become apparent from the following description taken in conjunction with the preferred embodiments thereof with reference to the accompanying drawings, throughout which like parts are designated by like reference numerals, and in which.

DETAILED DESCRIPTION OF THE PREFERRED EMBODIMENT

Figure 1:
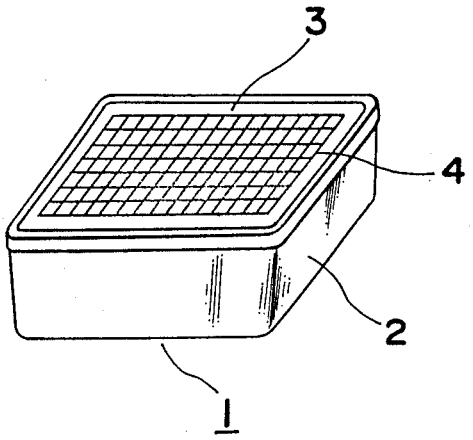
FIG. 1 is a perspective view of a storage receptacle according to a first embodiment of the present invention.

Referring now to the drawings, a hermetically covered storage receptacle of the present invention will be explained hereinbelow according to preferred embodiments thereof.

Figure 2:
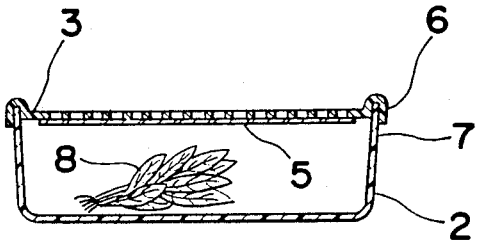
FIG. 2 is a vertical sectional view of the storage receptacle of FIG. 1.

There is shown in FIGS. 1 and 2, the hermetically covered storage receptacle 1 of the present invention having a receptacle body 2 opened on its upper side and a cover 3 for covering the receptacle body 2. The cover 3 substantially in the form of a plate is provided with a plurality of latticed openings 4 defined therein and a permeable film 5 which is bonded on the inner surface of the cover 3 by a bonding material or the like so as to cover the latticed openings 4. The peripheral portion 6 of the cover 3 is shaped, in cross section, substantially in the form of an inverted figure "U" and is closely engaged with the peripheral edge portion 7 of the receptacle body 2 for complete seal of the storage receptacle 1. Both the receptacle body 2 and the cover 3 are molded products of synthetic resin having superior fitability for air tightness, such as polyethylene, polypropylene or the like.

Hereupon, with reference to FIG. 3, the permeable film 5 will be explained in detail hereinafter.

The permeable film 5 is a laminated member composed of a base cloth 5*a* of a fibrous layer such as polyester, nylon or the like, a silicone resin thin film 5*b* having a thickness from microns to several tens of microns and integrally formed on the base cloth 5*a*, and a protective fibrous layer 5*c* formed on the silicone resin thin film to protect it from being broken. The permeable film 5 is regulated in moisture permeability from 1500 to 3500 $g/m^2 \cdot 24$ hr. The regulation of the moisture permeability is primarily achieved by changing the thickness of the silicone resin thin film 5*b*. More specifically, the silicone resin thin film 5*b* is substantially composed of a chain molecule aggregate of amorphous and the linearly formed molecule aggregate completely shuts out a liquid. The silicone resin thin film 5*b*, however, has a permeability to gases through molecule intervals of 10 to $10^3$ Å and permits water moisture, air, carbon dioxide gas or the like to permeate therethrough, if there exists a concentration difference between opposite sides thereof. Furthermore, the moisture permeability can be also more or less regulated by changing the thickness or weave pattern of the base cloth 5*a* or the protective fibrous layer 5*c*. The aforementioned value of the moisture permeability is a value measured in accordance with a method of testing moisture permeability of moisture-proof packaging material based on JIS (Japanese Industrial Standard). The reason why the moisture permeability of the permeable film 5 is regulated in the range of the above described numerical values resides in a discovery such that there exists a desirable balance between an effect of preventing the moisture condensation on the wall surface of the storage receptacle 1 and another effect of preventing the food, for example, the vegetables 8 or the like from being dried, as a result of repeated experiments which have been performed in a manner that upon containment of food having a large moisture content such as vegetables 8 or the like within the storage receptacle 1, the food accommodated within the storage receptacle 1 is stored in the atmosphere at a temperature from 0° to 30° C. Moreover, the area required for the permeable film 5 to be used depends upon the volume of the hermetically covered storage receptacle 1 and the kind of food to be accommodated therein. For example, in the case where the storage receptacle 1 is used as a receptacle for storing therein the leafy vegetables such as spinach or the like, the permeable film 5 having the area of approximately 0.1 $m^2$ is used for each 50 liters of volume of the sealed storage receptacle 1 according to the experimental results.

Figure 4:
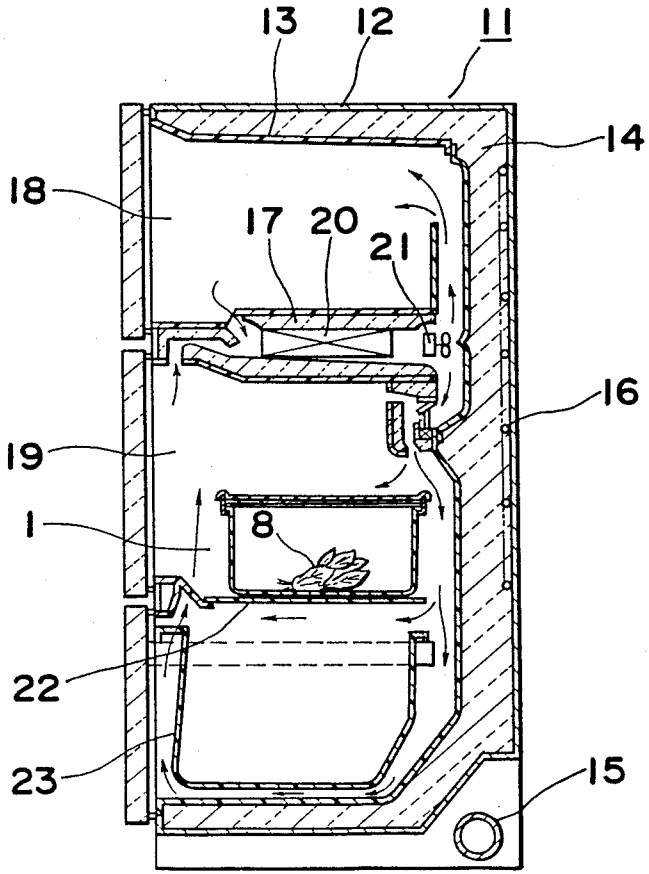
FIG. 4 is a vertical sectional view of a refrigerator accommodating therein the storage receptacle of FIG. 1.
Figure 7:
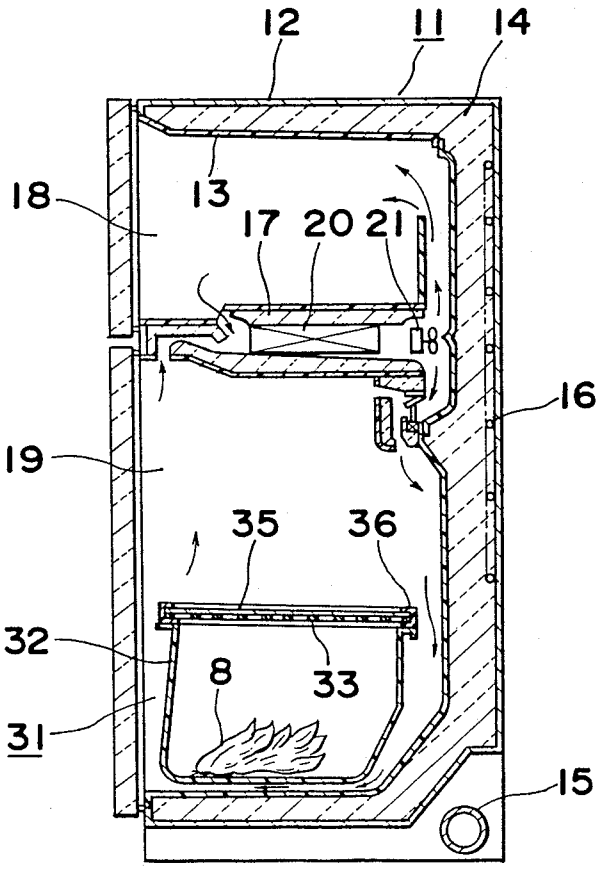
FIG. 7 is a view similar to FIG. 4, in which the storage receptacle according to a third embodiment of the present invention is accommodated in the refrigerator.

FIG. 4 illustrates a state where the storage receptacle 1 storing therein the vegetables 8 is accommodated in a coldroom of the refrigerator. The refrigerator has a refrigerator body 11 composed of an external box 12, an internal box 13 and a foamed heatinsulating material 14 filled between both boxes 12 and 13. There are provided a compressor 15 disposed outside the bottom of the refrigerator body 11 to compress a refrigeration medium and a condenser 16 disposed inside a back plate of the external box 12 to condense the refrigeration medium compressed by the compressor 15. The inside of the internal box 13 is partitioned into a freezer 18 and a coldroom 19 by a partition wall 17 and there are provided inside the partition wall 17, an evaporator 20 for evaporating the refrigeration medium condensed in the condenser 16 and a fan 21 for ventilating the cold air cooled down by the evaporator 20 back to the inside of the refrigerator 11. The storage receptacle 1 of the present invention is provided on a shelf 22 disposed inside the coldroom 19. Meanwhile, in FIG. 4, a receptacle 23 opened on its upper side and disposed at the bottom of the coldroom 19 is a conventionally known one for storing therein the vegetables or the like.

By the above described construction, through operation of a refrigeration cycle including the compressor 15, condenser 16 and evaporator 20, and through rotation of the fan 21, the insides of the freezer 18 and coldroom 19 are cooled down to respective predetermined temperatures and accordingly, the storage receptacle 1 accommodated within the coldroom 19 is cooled down simultaneously.

Such being the refrigerator in construction, when vaporish vegetables 8 such as spinach or the like are contained in the storage receptacle 1 sealed in appearance and kept in cold storage, the water content i.e., vapor vaporized from the vegetables 8 has primarily formed dew on the surface of the cover 3 so far. In this embodiment, however, since the vapor permeates through the permeable film 5 outside the storage receptacle 1 at an appropriate speed, as shown by arrows in FIG. 3, it is possible not only to keep the inside of the storage receptacle in a desirable high humidity of around 80 to 95% RH (Relative Humidity), but also to prevent the condensation of the vapor on the inner wall of the storage receptacle 1 including the cover 3. Accordingly, since the condensed water never form droplets on the surfaces of the vegetables 8 or at the bottom of the storage receptacle 1, the vegetables 8 stored therein are restrained from being dried and withered and never are spoiled over a period of time through damage thereof by the condensed water. As a result, the vegetables 8, particularly the leafy vegetables such as spinach or the like, can be stored desirably for a longer period than before.

Figure 5:
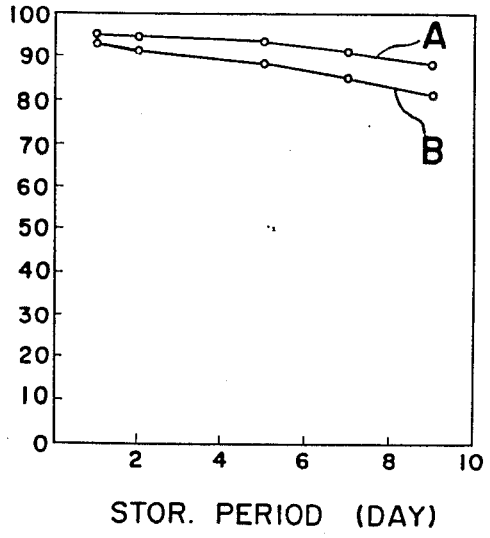
FIG. 5 is a graph showing a change of humidity inside the storage receptacle with time in a cold storage as shown in FIG. 4.

FIG. 5 graphically shows a change in humidity with time within the receptacle in the case where the spinach has been kept in cold storage with the use of the storage receptacle 1 of the present invention, and teaches that the inside of the storage receptacle 1 is kept for a relatively long period at a humidity of 80 to 95% RH suitable for the storage of the vegetables. In this experiment, the volume of the storage receptacle 1 is 42 liters, the area of the opening defined in the cover 3 is 1,000 $cm^2$ and the moisture permeability of the silicone resin thin film 5*b* is 2,100 $g/m^2 \cdot 24$ hrs. Furthermore, the case where the spinach of approximately 2 kg or 0.5 kg is accommodated within the storage receptacle 1 is respectively shown by a line A or B in FIG. 5.

It is to be noted that in this embodiment, the silicone resin thin film 5*b* may be replaced by a thin film of polyamino acid type urethane or the like having the moisture permeability as well. It is also to be noted that the bonding of the permeable film 5 onto the cover 3 can be executed by a method of fusion-bond through a hot plate.

Figure 6:
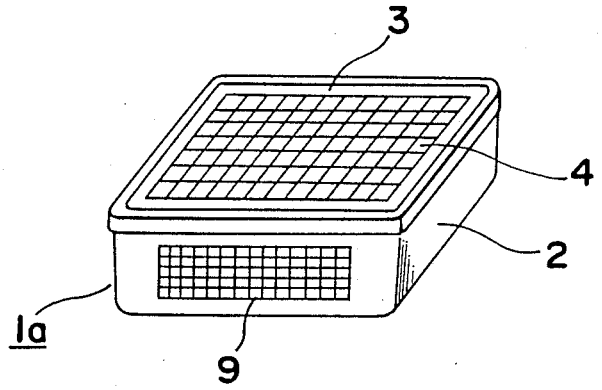
FIG. 6 is a view similar to FIG. 1 according to a second embodiment of the present invention.
Figure 8:
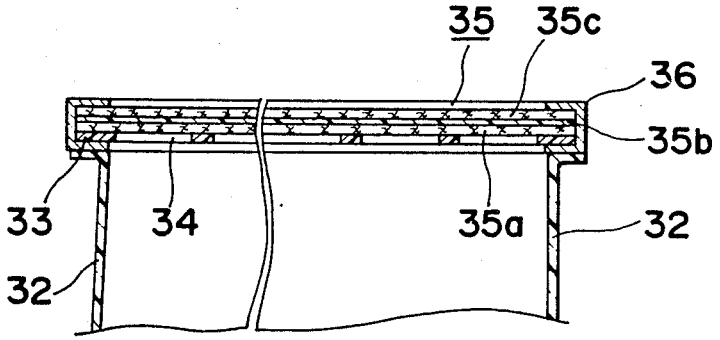
FIG. 8 is an enlarged fragmentary vertical sectional view of a main portion of the storage receptacle of FIG. 7.
Figure 9:
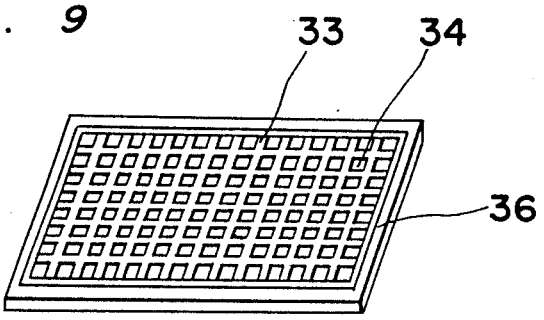
FIG. 9 is a perspective view of the cover of the storage receptacle of FIG. 7.

In the next place, with reference to FIG. 6, the sealed type storage receptacle 1*a* according to a second embodiment of the present invention will be explained hereinbelow. FIG. 6 shows the sealed type storage receptacle 1*a* according to the second embodiment of the present invention, which differs from the first embodiment in that a plurality of latticed openings 9 are additionally defined in a part of a side wall of the receptacle body 2 and are covered with the permeable film 5 as well as those defined in the cover 3. This additional provision of the permeable film 5 is based on the fact that in the case where the sealed type storage receptacle 1*a* is placed on a shelf or the like disposed within the refrigerator of forced circulation type, the storage receptacle 1*a*, particularly the side wall thereof is occasionally strongly cooled down, though there is some difference according to the way the storage receptacle 1*a* is placed in the refrigerator. Accordingly, the condensation which tends to arise on the inner wall of the receptacle is prevented by additionally providing the permeable film 5 on the side wall of the receptacle body 2. In this second embodiment as well as in the first embodiment, the vegetables, in particular, the leafy vegetables e.g., the spinach or the like can be stored in a fresh condition for a longer period than before.

Subsequently, with reference to FIGS. 7 through 10, a storage receptacle 31 for use in the refrigerator to contain therein the vegetables will be explained hereinafter according to a third embodiment of the present invention.

The explanation with respect to the refrigerator will be omitted for brevity's sake, since the construction thereof in this embodiment is the same as that shown in FIG. 4.

A receptacle body 32 having, on its upper side, an opening portion closely covered with a cover 33 is substantially similar in configuration to the receptacle 23 shown in FIG. 4. The cover 33 composed of olefin thermoplastic resin or the like, for example polyethylene etc., is provided with a plurality of latticed openings 34 defined therein, permeable film 35 securely fusion-bonded on one surface of the cover 33 and a packing 36 of rubber such as vinyl chloride or the like disposed on the periphery of the permeable film 35. The storage receptacle 31 for containing therein the vegetables is detachably disposed at a predetermined position inside the coldroom 19 of the refrigerator body 11 at the bottom thereof, while being tightly covered with the cover 33 having the rubber-make packing 36 at the periphery thereof.

Hereupon, the aforementioned permeable film 35 will be described in detail hereinbelow.

The permeable film 35 is a laminated member including a base cloth 35*a* of polyester weave such as polyester taffeta or polyester knit, a silicone resin thin film 35*b* having a thickness of several tens of microns and formed on the base cloth 35*a*, and a protective fibrous layer 35*c* composed of polyester taffeta or polyester knit and formed on the silicone resin thin film 35*b* to prevent the break thereof. The reason why polyester taffeta or polyester knit is employed for the base cloth 35*a* and the protective fibrous layer 35*c* is based on the fact that as a result of an experiment, either of these materials has been found out superior to other fabrics such as nylon and the like in stain resistance with respect to such food as juice, coffee, soy or the like and suitable for use in the refrigerator. The permeable film 35 is fusion-bonded, at one surface of the base cloth 35*a*, onto the cover 33. Although it is difficult to fusion-bond the silicone resin thin film 35*b* itself, which is superior in permeability, onto the cover 33, if the base cloth 35*a* is disposed therebetween as described above and the cover 33 is thermally pressed against the permeable film 35 to a certain extent not to damage the openings 34, the permeable film 35 can be bonded with the cover 33, since the molten polyolefin resin bites into the weave patterns of the base cloth 35*a*. In the case where the thermal fusion-bond is employed as a bonding means as described above, since the molten resin is liable to bite into gaps defined in the base cloth 35*a* of polyester knit as compared with that of polyester taffeta, the former is superior in bond strength to the latter.

Figure 10:
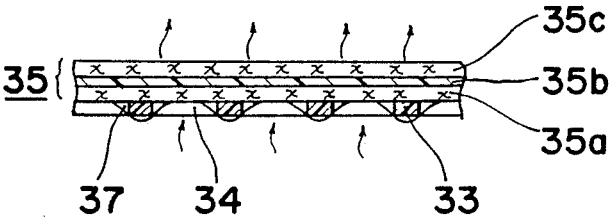
FIG. 10 is an enlarged fragmentary sectional view of the cover of FIG. 8 for showing an operation thereof.

Such being the construction, the cold air never enters the vegetable storage receptacle 31 directly and the inside thereof is desirably kept in appropriately high humidity by the moisture vaporized from the vegetables 8 stored therein. Although the moisture exceeding the saturated humidity tends to form dew on the inner surface of the cover 33 which faces the coldroom 19 and is, therefore, cooled down to the utmost by the cold air strongly blowing thereagainst, the moisture gradually permeates through the permeable film 35 formed on the cover 33 into the coldroom 19, as shown by arrows in FIG. 10, while the inside of the coldroom 19 is kept in a dry condition by the evaporator 20 disposed within the refrigerator. Furthermore, even when some quantity of moisture condensation 37 arises at times on the cover 33 of a support member having a plurality of openings 34, as shown in FIG. 10, in the case where a large amount of the vegetables are stored in the storage receptacle 31 and a considerable amount of the moisture is vaporized, the moisture condensation vaporizes to gradually vanish. Accordingly, since the moisture condensation never drops to stay on the surface of the vegetables 8 or at the bottom of the vegetable storage receptacle 31, the vegetables 8 stored is not only restrained from being dried or withered, but also not damaged by water drops, thus resulting in that the vegetables 8, particularly the leafy vegetables such as spinach or the like, can be stored desirably in the fresh condition for a longer period than before. It is to be noted that the silicone resin thin film 35*b* in this embodiment may be replaced by a finely porous thin film of tetrafluoro ethylene or polyurethane having the same permeability as the former.

Figure 11:
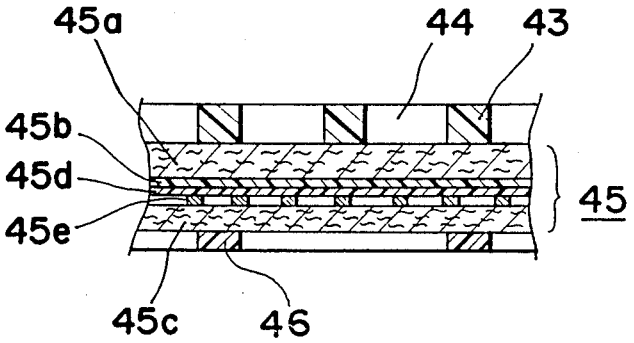
FIG. 11 is an enlarged fragmentary sectional view of a main portion of the cover of the storage receptacle according to a fourth embodiment of the present invention.

With reference to FIG. 11, the storage receptacle according to a fourth embodiment of the present invention will be explained hereinafter. It should be noted that since this embodiment is different from the aforementioned embodiments only in the construction of the permeable film, no entire construction of the receptacle body and the storage receptacle having the cover 43 will be shown in any drawing for brevity's sake.

A permeable film 45 is a laminated member composed of a base cloth 45*a* of polyester, nylon or the like, a silicone resin thin film 45*b* having a thickness of several tens of microns and formed on the base cloth 45*a*, a urethane thin film 45*d* having a thickness of several microns and formed on the silicone resin thin film 45*b*, a bond layer 45*e* and a protective fibrous layer 45*c* covered on the urethane thin film 45*d* through the bond layer 45*e* to protect the break of the silicone resin thin film 45*b* or the urethane thin film 45*d*. The permeable film 45 is fusion-bonded, at one surface of the base cloth 45*a*, with the cover 43. Although it is difficult to fusion-bond the silicone resin thin film **45*b* itself onto the cover 43, if the base cloth 45*a* is disposed therebetween and the cover 43 is thermally pressed against the permeable film 45 to a certain extent not to damage the openings 44, the permeable film 45 can be bonded with the cover 43, since the molten polyolefin resin bites into the weave patterns of the base cloth 45*a*. Except the method of fusion-bonding, there exists, as the method of bonding, the bonding by a bonding agent or a method of nipping the permeable film between a couple of plate members in the form of a net. The bond layer 45*e* is composed of a plurality of thin bond films spaced at predetermined intervals formed on either the urethane thin film 45*d* or the protective fibrous layer 45*c* through a processing method generally called "bonding dot process" and, the urethane thin film 45*d* and the protective fibrous layer 45*c*** are bonded with each other.

Hereupon, an explanation will be made hereinbelow with respect to an operation of the urethane thin film **45*d***.

When the silicone resin thin film is directly covered, at its one surface, with the protective fibrous layer **45*c*, sufficient bonding strength can not be obtained therebetween. The urethane thin film 45*d* is, therefore, formed as thin as possible on the silicone resin thin film 45*b* so as not to disturb the permeability and as a result, the bonding of the silicone resin thin film 45*b* with the protective fibrous layer 45*c*** is increased in bonding strength.

Figure 3:
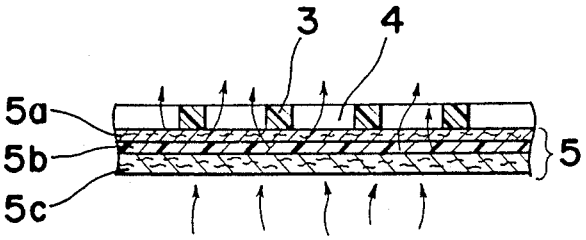
FIG. 3 is an enlarged fragmentary section of a cover shown in FIG. 2.

There is substantially no difference in function between the permeable film formed on the inner surface of the cover as shown in FIG. 3 and that formed on the outer surface thereof as shown in FIG. 10. However, when some parts or some objects accidentally drop onto the cover in the case where the permeable film is formed on the upper surface of the cover as shown in FIG. 10, the permeable film is directly hit by the falling object and is, therefore, subject to damage. Accordingly, it is preferable to form a permeable film on the inner surface of the cover as shown in FIG. 3. In the construction shown in FIG. 3, there is still such a problem as the deformation of the permeable film or the drop thereof from the cover. Accordingly, it is further preferable to provide an additional support member 46 for supporting the lower surface of the permeable film, as shown in FIG. 11.

It is also desirable to apply the bacteriaproofing and fungusproofing high in safety for fibers with respect to the base cloth and the protective fibrous layer. A quaternary ammonium salt is employed as a bacteriaproofing or fungusproofing agent and is chemically bonded on the surface of the fibers through an organic silicone as a medium. For example, a treatment called "Biosil Treatment" developed by Toyobo Co., Ltd. is employed to this purpose. A further explanation will be made here with respect to the aforementioned treating agent. Although it is conventionally known that the quaternary ammonium salt restrains microbes from growing up, since it is difficult to directly chemically bond this chemical compound with the fibers, the quaternary ammonium salt and the fibers are chemically bonded with each other through the organic silicone as a crosslinker. Accordingly, the quaternary ammonium salt never dissolve in cleaning or washing, thus resulting in that a bacteriaproofing or fungusproofing effect lasts long in safety.

Although the present invention has been fully described by way of examples with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A vegetable storage receptacle particularly effective for leafy vegetables for use in a refrigerator, which comprises:

a receptacle body of synthetic resinous material opened on its upper side;

a covering member of synthetic resinous material for covering the opening portion of said receptacle body;

a permeable film member formed on said covering member so as to cover a plurality of openings defined therein, said permeable film member being composed of a base cloth of a fibrous layer, a synthetic resinous thin film formed on said base cloth and having a permeability to gases between its molecules spaced at intervals of 10 to $10^3$ Å and a protective fibrous layer covered on said thin film, said thin film having a thickness of several microns to several tens of microns, said permeable film member having an area of approximately 0.1 $m^2$ for each 50 liters of the vegetable storage receptacle, and wherein the moisture permeability of said permeable film from the inside of said receptacle towards the outside is 1500 to 3500 $g/m^2 \cdot 24$ hr by virtue of said thickness of said thin film.

2. The receptacle according to claim 1, wherein said base cloth and said protective fibrous layer are of polyester taffeta or polyester knit.

3. A vegetable storage receptacle particularly effective for leafy vegetables for use in a refrigerator, which comprises:

a receptacle body of synthetic resinous material opened on its upper side;

a covering member of synthetic resinous material for covering the opening portion of said receptacle body;

a permeable film member formed on said covering member so as to cover a plurality of openings defined therein, said permeable film member being composed of a base cloth of a fibrous layer, a synthetic resinous thin film formed on said base cloth and having a permeability to gases between its molecules spaced at intervals of 10 to $10^3$ Å, a urethane thin film formed on said resinous thin film and a protective fibrous layer covered on said urethane thin film through a bond layer, said resinous thin film having a thickness of several microns to several tens of microns, said permeable film member having an area of approximately 0.1 $m^2$ for each 50 liters of the vegetable storage receptacle, and wherein the moisture permeability of said permeable film from the inside of said receptacle towards the outside is 1500 to 3500 $g/m^2 \cdot 24$ hr by virtue of said thickness of said resinous thin film and said protective fibrous layer is located on an inner side of said receptacle.

* * * * *